US006607092B2

(12) United States Patent
Manganiello et al.

(10) Patent No.: US 6,607,092 B2
(45) Date of Patent: Aug. 19, 2003

(54) CUP ASSEMBLY WITH RETAINING MECHANISM

(75) Inventors: Francis X Manganiello, Pompton Plains, NJ (US); Ross Steven Randolph, Rockaway, NJ (US)

(73) Assignee: Playtex Products, Inc., Westport, CT (US)

( * ) Notice: Subject to any disclaimer, the term of this patent is extended or adjusted under 35 U.S.C. 154(b) by 0 days.

(21) Appl. No.: 09/908,099

(22) Filed: Jul. 18, 2001

(65) Prior Publication Data

US 2002/0033399 A1 Mar. 21, 2002

Related U.S. Application Data

(63) Continuation-in-part of application No. 09/645,975, filed on Feb. 4, 2000, which is a continuation of application No. 09/019,765, filed on Feb. 6, 1998, now Pat. No. 6,050,445.

(51) Int. Cl.[7] ..... A47G 19/22
(52) U.S. Cl. ..... 220/714; 220/717
(58) Field of Search ..... 220/203.02, 203.11, 220/203.17, 203.18, 254.1, 303, 703, 705, 711, 714, 717, 719, 721, 724, 373, 363, 367.1; 215/11.4, 11.5, 387–389, 307, 309–311

(56) References Cited

U.S. PATENT DOCUMENTS

| | | | | |
|---|---|---|---|---|
| 3,739,938 A | * | 6/1973 | Paz | 220/715 |
| 5,079,013 A | | 1/1992 | Belanger | |
| 5,085,336 A | | 2/1992 | Lynd | |
| 5,542,670 A | | 8/1996 | Morano | |
| 5,706,973 A | * | 1/1998 | Robbins et al. | 220/714 |
| 5,890,620 A | | 4/1999 | Belcastro | |
| 5,890,621 A | | 4/1999 | Bachman et al. | |
| 5,988,425 A | * | 11/1999 | Yehl et al. | 220/714 |
| 6,050,445 A | | 4/2000 | Manganiello | |
| 6,062,419 A | | 5/2000 | Krüger et al. | |
| RE37,016 E | | 1/2001 | Morano | |
| 6,269,968 B1 | | 8/2001 | Belcastro | |
| 2001/0035420 A1 | * | 11/2001 | Fusco et al. | 220/714 |

FOREIGN PATENT DOCUMENTS

| | | | |
|---|---|---|---|
| DE | 29714169 | * | 1/1998 |
| GB | 2155307 | * | 9/1985 |

* cited by examiner

*Primary Examiner*—Nathan J. Newhouse
(74) *Attorney, Agent, or Firm*—Ohlandt, Greeley, Ruggiero & Perle, LLP

(57) ABSTRACT

A drinking cup assembly having a cup having an open end, a cap adapted to enclose the open end, the cap having a drinking spout and an air vent and a pair of mating surfaces that align with the drinking spout and the air vent, and a removable flow control valve adapted to engage the mating surfaces. The cap has a retaining mechanism that in conjunction with one mating surface secures in place the flow control element when not in use.

19 Claims, 4 Drawing Sheets

CUP ASSEMBLY WITH RETAINING MECHANISM

RELATED APPLICATIONS

This application is a continuation-in-part of prior U.S. patent application Ser. No. 09/645,975 filed on Feb. 4, 2000, which is a continuation of prior U.S. patent application Ser. No. 09/019,765 filed on Feb. 6, 1998, which issued on Apr. 18, 2000, as U.S. Pat. No. 6,050,445.

BACKGROUND OF THE INVENTION

1. Field of the Invention

The present invention relates generally to an improved leak-proof cup. More particularly, the present invention relates to a cup assembly having a drinking spout, an air vent spaced from the drinking spout, and a removable flow control element that engages in the vicinity of the drinking spout and air vent to control the flow of liquid and air from the drinking spout and the air vent. Moreover, the present invention provides a retaining mechanism to frictionally engage the flow control element when in a non-use or storage position.

2. Description of the Prior Art

Drinking cups having one or more drinking spouts and a separate air vent. These cups allow the user to drink from the spout without creating excessive vacuum in the cup. However, drinking spouts and air vents are liable to leak liquid stored in the cup between feedings, or if dropped during use. Accordingly, certain drinking cups have been developed that use one or more removable flow control elements or valve mechanisms at the spout and at the air vent. These valve mechanisms respond to suction generated during feeding to open and allow liquid to pass through the spout and to allow air to enter the air vent when a vacuum is developed in the interior of the cup.

Two patents that disclose such removable valve mechanisms are U.S. Pat. No. 5,079,013 to Belanger and U.S. Pat. No. 5,542,670 to Morano, both commonly owned by the assignee of the present application.

Applicant is aware of a competitive product having a flow control element of the configuration depicted in FIG. 4, sold as part of the Tumble Mates Spill Proof Cup by the First Years. Applicant has on the market a cup that employs a valve assembly discussed in priority U.S. Pat. No. 6,050,445. The removable flow control element or valve mechanism is shown in FIG. 3 of this application. These flow control elements are sold in position in the sleeves that extend from the underside of the cup's top or lid or are separated from the cup in the package. With both of these cups, the flow control elements are positioned in the sleeve and when removed from the sleeve is simply left in free. There is no provision for placement of the flow control element when out of the sleeve.

In addition, despite the effectiveness of these mechanisms, applicant has discovered a way to improve flow rates by the combination of the flow control element, such as that disclosed in U.S. Pat. No. 6,050,445, and corresponding element or valve positioning sleeve without sacrificing the valve's resistance to spills or the valve's durability.

SUMMARY OF THE INVENTION

It is an object of the present invention to provide a combination flow control element and corresponding element positioning member that reduces the amount of liquid left in the spout of the cup.

It is another object of the present invention to provide a mechanism for holding the removable flow control element or valving mechanism for a cup when not is use.

These and other objects and advantages of the present invention are achieved by a drinking cup assembly including a cup having an open end; a cap or lid adapted to enclose the open end, the cap including a drinking spout and an air vent and a pair of mating surfaces, one mating surface being aligned with the drinking spout and the other mating surface being aligned with the air vent; and a removable flow control valve having two valve portions each adapted to engage mating surface so that the valve portion aligned with the spout is positioned above the liquid line in the cup than the valve portion aligned with the air vent.

Moreover, the present invention includes a retaining mechanism for retaining the flow control element in the underside of the cap or lid when the flow control element is not in use. The retaining mechanism includes a projection that extends downward from the underside of the cap in close proximity to one of the two mating surfaces so that a space is formed therebetween for retaining the flow control element when it is not in use.

DESCRIPTION OF THE INVENTION

Figure 1:
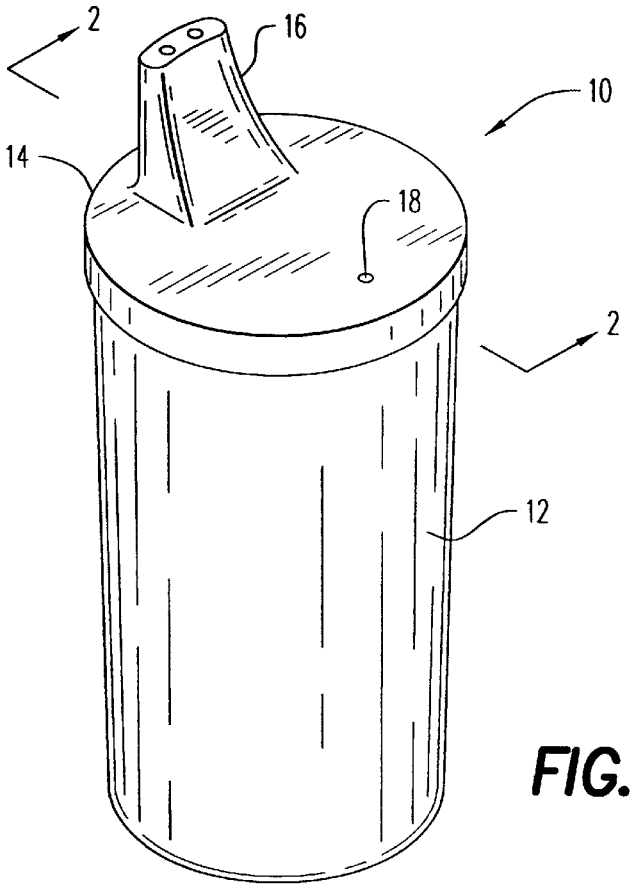
FIG. 1 is a perspective view of a conventional trainer cup.

Referring to the figures and, in particular, FIG. 1, a cup is generally referred to by reference numeral 10. The cup 10 includes a container 12 and a cap or lid 14 that is adapted to seal cup 12. The cap or lid 14 has a spout 16 and an air vent 18 formed in its surface.

Figure 2:
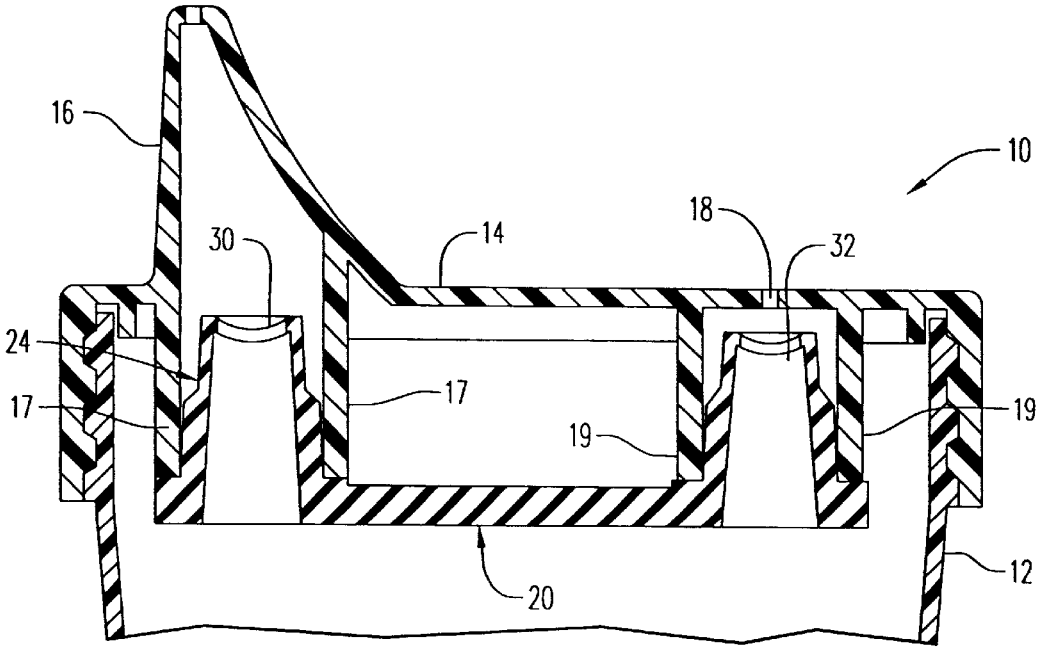
FIG. 2 is a cross-sectional view of the trainer cup showing the placement of the removable valve of U.S. Pat. No. 6,050,445.

Referring to FIG. 2, lid 14 has, extending from the undersurface thereof, a first sleeve 17 and a second sleeve 19. The first sleeve 17 and second sleeve 19 are preferably cylindrical in shape. The first sleeve 17 aligns with spout 16, while second sleeve 19 aligns with air vent 18.

Figure 3:
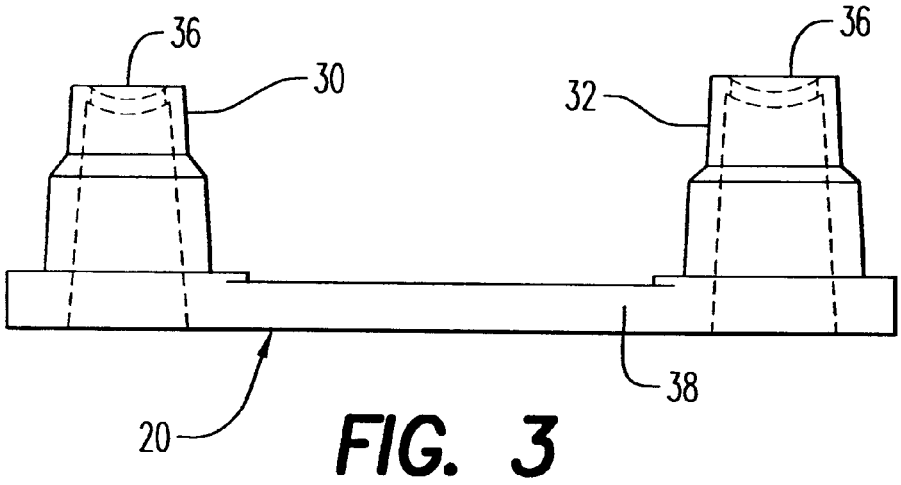
FIG. 3 is a side elevation view of the flow control element of U.S. Pat. No. 6,050,445.

Referring to FIG. 3, flow control element or valve mechanism 20 has first valve portion or stack 30 and second valve portion or stack 32 connected together by substrate 34. Each valve portion 30, 32 has a lower portion 26, an upper portion 28 and valve faces 36 bearing slits. Each valve portion 30, 32 is configured, to frictionally engage first sleeve 17 and second sleeve 19, respectively, and place the flow control valve in fluid communication with spout 16 and air vent 18, respectively.

The flow control element 20 shown in FIG. 3 is that described in priority U.S. Pat. No. 6,050,445, which is incorporated in its entirety by reference. This flow control element 20 preferably has a concave shaped valve face 36 of valve portions 30 and 32, in conjunction with the attendant curved shape of slits, provide superior fluid flow rate through the slit than existing valve configurations. This makes cup 10 easier to drink from and less frustrating and tiring to use.

Figure 4:
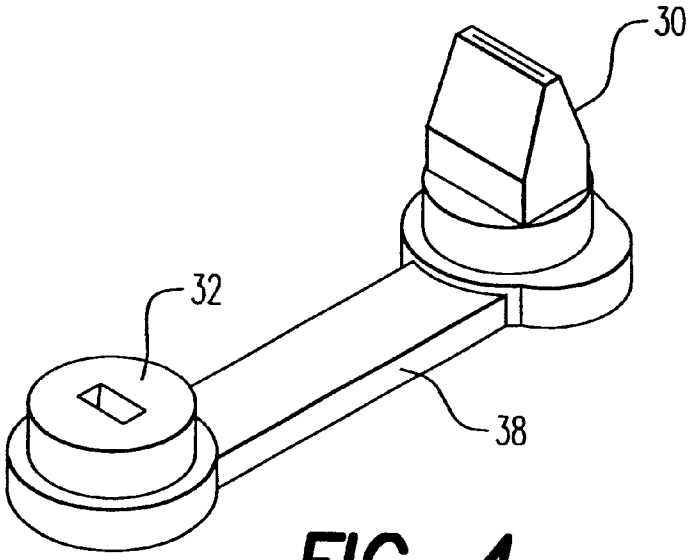
FIG. 4 (PRIOR ART)
FIG. 4 is a perspective view of a prior art flow control element or valve mechanism.

Likewise, the flow control element 20 in the prior art shown in FIG. 4, also has two valve portions 30, 32. Valve portion 30 is a duck bill valve that aligns with the spout, while valve portion 32 is a short circular step that aligns with the air vent. In both this and the FIG. 3 flow control element, the cups having this flow control elements provide that the flow control element, and thus each valve portion, is about level in the liquid in the container.

It is preferred that the removable flow control valve 20 be formed from a single piece of elastomeric material to facilitate easy insertion into and removal from first and second sleeves 17, 19. The elastomeric material used is most preferably silicone, but TPE (thermoplastic elastomer), natural rubber, and synthetic rubber (e.g., isoprene) are also preferred.

Figure 5:
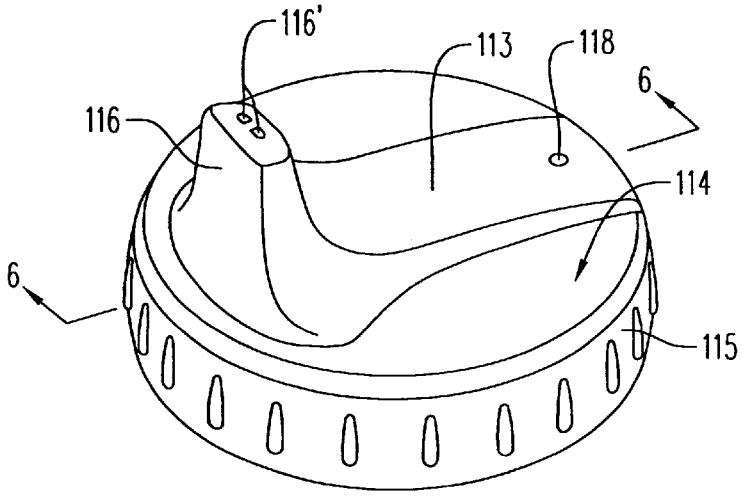
FIG. 5 is a top perspective view of the cap of the present invention.

FIGS. 5 through 8 show cap 114 of the present invention. As shown in FIG. 5, cap 114 includes a lip 115 and an enlarged curved surface or step 113 across a majority of the extent of the top or upper surface of the cap. This surface 119 has a spout 116 with spout aperture 116', and an air vent 118 therethrough.

Figure 7:
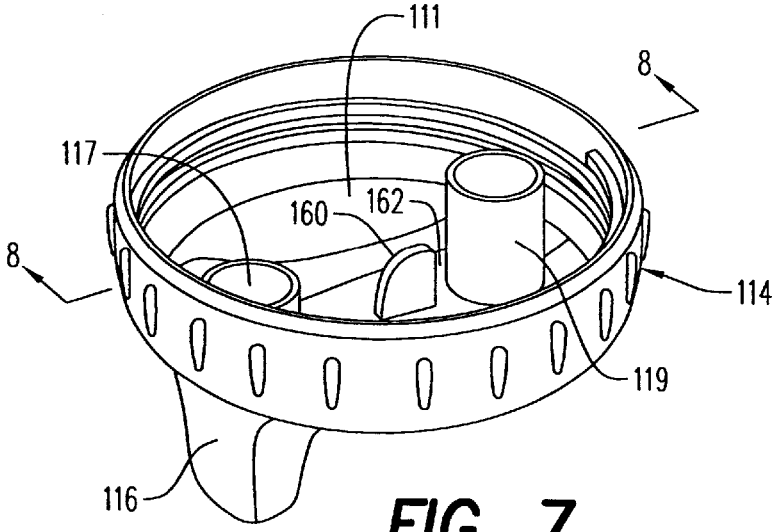
FIG. 7 is a bottom perspective view of the cap of FIG. 5.
Figure 8:
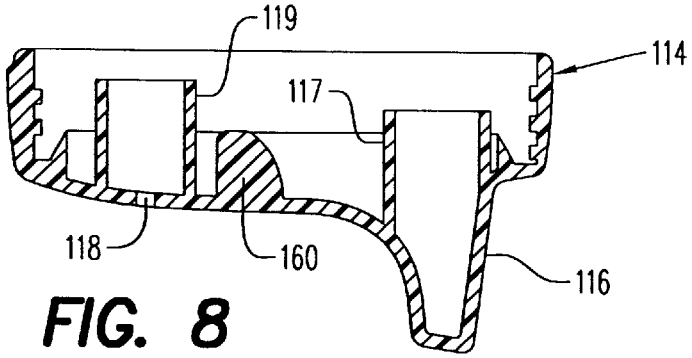
FIG. 8 is a cross-sectional view taken along lines 8—8 of FIG. 7.
Figure 6:
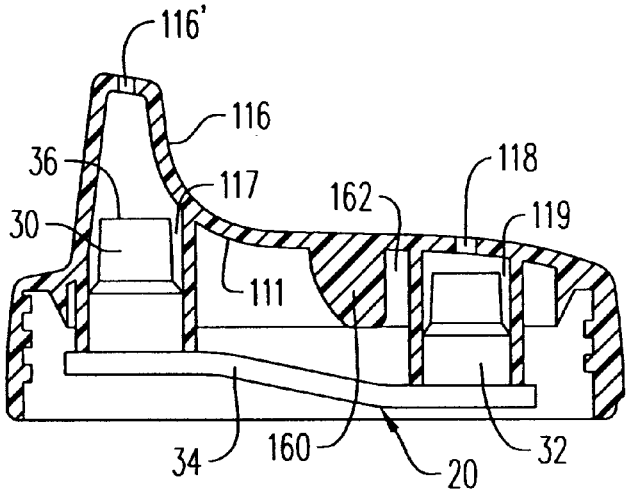
FIG. 6 is a cross-sectional view taken along lines 6—6 of FIG. 5.

Referring to FIGS. 6 to 8, as compared to FIG. 2, first sleeve 117 is shorter or has a less vertical extent than sleeve 17 of FIG. 2 or another prior art sleeve. As shown in the Figs., second sleeve 119 may be the same height as sleeve 19 of FIG. 2, or it can also have less of a vertical extent than sleeve 19.

As shown clearly in FIGS. 6 and 8, it is important that first sleeve 117 has a shorter elongation or vertical extent than sleeve 17 so that the valve face 36 of first valve portion 30 is closer to the aperture 116' of spout 116. It has been found that this arrangement provides for a good balance of suction. Moreover, this arrangement reduces the amount of residual fluid that remains in the cup than would otherwise be provided. Thus, cap 114 enables the user to remove all or substantially all of the fluid or liquid that would otherwise remain in the cup. Therefore, cap 114 in combination with the positioning of first valve portion 30 of flow control element 20 with respect to spout 116 especially aperture 116' enables less residual fluid or liquid to remain in the cup. In other words, first sleeve portion 117 of spout 116 is positioned further away from the level of the remaining fluid or liquid in the cup than provided in the prior art. In still other words, first sleeve portion 117 of spout 116 is recessed further towards bottom surface 111 of cap 114 than provided in the prior art. Accordingly, first sleeve portion 117 of spout 116 positions first valve portion 30 of flow control valve 20 further away from the level of residual fluid or liquid in the cup than provided in the prior art. In the preferred embodiment shown in the drawings, sleeve portion of spout 116 positions first valve portion 30 of flow control valve 20 further away from the level of liquid in the cup than second sleeve portion 119 positions second valve portion 32 (however, the second sleeve portion can position second valve portion 32 at the same level as first valve portion 30 shown in this application).

The following data demonstrate the improvements provided by cap 114 with regards to the amount of residual fluid remaining in the cup. Ten samples of cap 14 were tested using a small cup, Test A, and ten samples of cap 14 were tested using a large cup, Test B. This data is compared against five samples of cap 114 as depicted in FIGS. 5 through 8 tested using a small cup (same size as for Test A), Test C, and five samples of cap 114 tested using a large cup (same size as for Test B), Test D.

During the tests, the cups were filled with liquid and caps 14, 114 were secured thereon. Liquid filled cups were held such that caps 14, 114 were at an angle of about 30 degrees below horizontal. Suction was applied to spouts 16, 116 until the flow of liquid from cups ceased. The amount of liquid remaining in cups was then measured in milliliters and recorded.

| Sample No. | Cap 14 Small Cup | Cap 14 Large Cup | Cap 114 Small Cup | Cap 114 Large Cup |
|---|---|---|---|---|
| 1 | 15.1 | 17.9 | 8.5 | |
| 2 | 15.1 | 17.9 | 8.3 | |
| 3 | 13.7 | 17.6 | 9.1 | |
| 4 | 12.9 | 18.4 | 9.1 | |
| 5 | 13.9 | 18.7 | 8.9 | |
| 6 | 14.0 | 18.2 | | 7.6 |
| 7 | 13.2 | 18.4 | | 5.9 |
| 8 | 12.7 | 18.7 | | 5.7 |
| 9 | 13.7 | 18.4 | | 6 |
| 10 | 12.9 | 20.0 | | 5.7 |
| Average | 13.72 | 18.42 | 8.78 | 6.78 |

As can be seen from the data above, the relative positioning of first valve portion 30 in cap 114 with respect to the level of liquid in the cup provides the user with the ability to remove substantially more liquid from the cup.

As discussed above, cap 114 preferably has a step 113 formed therein. Spout 116, air vent 118 and first sleeve portion 117 and second sleeve portion 119 are formed in step 113. Thus, step 113 is adapted to indent or recess first sleeve portion 117 into or toward bottom surface 111 of cap 114 in the manner described above, which is a feature that further enhances the closer positioning of first valve portion 30 with respect to spout 116 especially aperture 116'.

Figure 9:
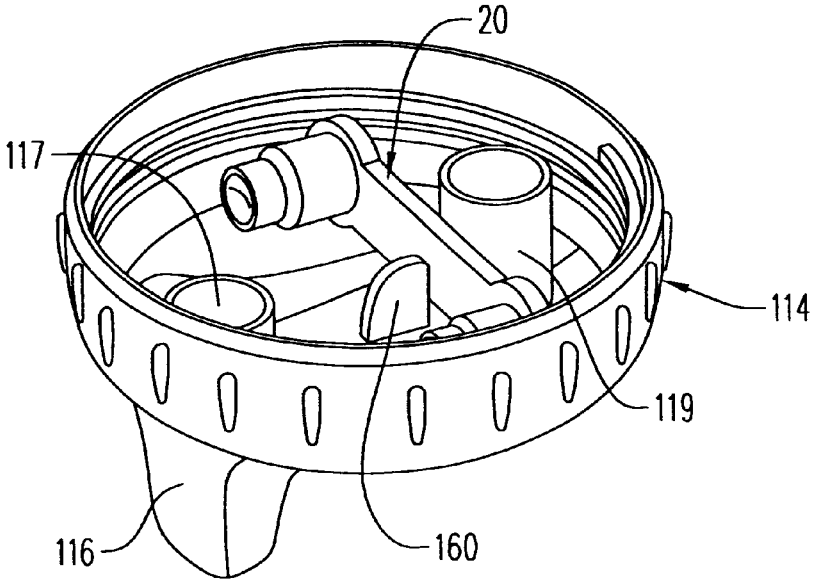
FIG. 9 is a bottom perspective view of the cap of FIG. 5, with the flow control element in its non-use position.

FIGS. 6 through 8 illustrate another important aspect of the present invention. Cap 114 has a retaining mechanism 160. The retaining mechanism 160 is preferably one or more protrusions formed or connected to the bottom or under surface 111 of cap 114 even though in the preferred embodiment shown, there is one protrusion. The retaining mechanism 160 is adapted to cooperate with at least one sleeve portion 117, 119 to frictionally engage substrate 34 of flow control valve 20 in a non-use or storage position. In a preferred embodiment, retaining mechanism 160 forms a space 162 between the retaining mechanism and an exterior surface of second sleeve portion 119. As shown in FIG. 9, flow control element 20 may be positioned in space 162 when the flow control element is not in use.

As stated above, retaining mechanism can be one or more protrusions. A protrusion means any embossment, abutment, extension or the like extending from the underside of the cap, and may include a slight recess in the underside of the cap. The retaining mechanism 160 can be of any geometric shape as long as it provides a surface 164 along an exterior surface 167, 169 of first or second sleeve portion 117, 119, respectively, of cap 114 that frictionally engages flow control valve 20 when placed in a non-use or storage position. Thus, the protrusion can be any shape, such as for example, a square, a rectangle, a pentagon, a hexagon, a cylinder, a pin, an arcuate surface or the like. Also, retaining mechanism 160, especially surface 164, may have any vertical or elongated extent. However, it preferably has a vertical or elongated extent that is almost the same, the same or slightly larger than that of width 38 (FIGS. 3 and 4) of substrate 34.

The retaining mechanism 160 shown in the figures is one protrusion. The shown protrusion is a thin walled partially arcuate structure.

More importantly, the space 162 formed between surface 164 of retaining mechanism 160 and either exterior surface 167 or, more preferably, exterior surface 169, must be sized to frictional engage width 38 (FIGS. 3 and 4) of substrate 34 of flow control element 20. Thus, substrate 34 being of an elastomeric material that readily adapts itself to be squeezed into space 162 to frictionally engage surfaces 164 and 119 is desired.

Various modifications may be made to the foregoing disclosure as will be apparent to those skilled in the art. Thus, it will be obvious to one of ordinary skill in the art that the foregoing description and drawings are merely illustrative of certain preferred embodiments of the present invention, and that various obvious modifications can be made to these embodiments in accordance with the spirit and scope of the appended claims.

What is claimed is:

1. A drinking cup assembly comprising:

a cup having an open end;

a cap for enclosing the open end, the cap having a drinking spout, the cap having a bottom surface with a pair of sleeves extending therefrom, one of the pair of sleeves being aligned with the drinking spout; and a removable flow control valve having two valve portions, each valve portion being engagable with a different one of the pair of sleeves, wherein the positioning of the valve portion aligned with the spout is selectively further away from the level of liquid in the cup than the other valve portion aligned with the other of the pair of sleeves, thereby minimizing the amount of residual liquid in the cup.

2. The drinking cup assembly of claim 1, wherein the sleeve engaging the valve portion aligned with the spout is recessed into the cap to enable removal of substantially all of liquid in the cup.

3. The drinking cup assembly of claim 1, wherein each of the pair of sleeves is cylindrical.

4. The drinking cup assembly of claim 1, wherein the cap further includes a vent.

5. The drinking cup assembly of claim 1, wherein the other one of the pair sleeves is aligned with the vent.

6. A drinking assembly comprising:

a container for holding a liquid having an open end;

a cap being removably positioned on the open end, the cap having a bottom surface with a valve sleeve extending therefrom; and a flow control element having a first valve portion, the improvement comprising:

a mechanism formed on the bottom surface of the cap, wherein the mechanism cooperates with the valve sleeve to retain the flow control element during non-use.

7. The drinking assembly of claim 6, wherein the mechanism and the valve sleeve engage the flow control element to retain the flow control element during non-use.

8. The drinking assembly of claim 6, wherein the valve sleeve is a pair of valve sleeves.

9. The drinking assembly of claim 6, wherein the mechanism and the valve sleeve form a space therebetween.

10. The drinking assembly of claim 9, wherein the flow control element can be positioned in the space.

11. The drinking assembly of claim 9, wherein the mechanism and the valve sleeve frictionally engage the flow control element during non-use.

12. The drinking assembly of claim 6, wherein the mechanism is a protrusion extending downward from the bottom surface of the cap.

13. The drinking assembly of claim 12, wherein the protrusion is a shape selected from the group consisting of a square, a rectangle, a pentagon, a hexagon, a cylinder, a pin, and an arcuate surface.

14. The drinking assembly of claim 12, wherein the protrusion has a vertical extent that is almost the same as a width of the flow control element.

15. The drinking assembly of claim 12, wherein the protrusion has a vertical extent that is the same as a width of the flow control element.

16. The drinking assembly of claim 12, wherein the protrusion has a vertical extent that is slightly larger that a width of the flow control element.

17. The drinking assembly of claim 12, wherein the protrusion is a pair of protrusions.

18. A drinking assembly comprising:

a container for holding a liquid having an open end;

a cap being removably positioned on the open end, the cap having a bottom surface with a pair of valve sleeves extending therefrom; and a flow control element having a first valve portion and a second valve portion, the improvement comprising:

a mechanism formed on the bottom surface of the cap, wherein the mechanism cooperates with one of said pair of valve sleeves to retain the flow control element during non-use.

19. The drinking assembly of claim 18, wherein the mechanism is a protrusion extending downward from the bottom surface of the cap.

* * * * *